US009925649B2

(12) United States Patent
Wyckhouse et al.

(10) Patent No.: US 9,925,649 B2
(45) Date of Patent: Mar. 27, 2018

(54) TOOL HEAD COVER

(71) Applicants: Timothy Wyckhouse, Monclova, OH (US); Kimberly Wyckhouse, Monclova, OH (US)

(72) Inventors: Timothy Wyckhouse, Monclova, OH (US); Kimberly Wyckhouse, Monclova, OH (US)

( * ) Notice: Subject to any disclaimer, the term of this patent is extended or adjusted under 35 U.S.C. 154(b) by 317 days.

(21) Appl. No.: 14/948,684

(22) Filed: Nov. 23, 2015

(65) Prior Publication Data

US 2016/0151894 A1 Jun. 2, 2016

Related U.S. Application Data

(60) Provisional application No. 62/085,390, filed on Nov. 28, 2014.

(51) Int. Cl.
*B25B 23/00* (2006.01)

(52) U.S. Cl.
CPC ..... *B25B 23/00* (2013.01)

(58) Field of Classification Search
CPC . B25G 1/01; B25G 1/02; B25G 1/025; B25G 1/10; B25G 1/102; B25G 1/12; B25B 23/00; B25B 23/0021; B25B 23/0035
USPC ..... 81/177.1, 177.2, 180.1, 184
See application file for complete search history.

(56) References Cited

U.S. PATENT DOCUMENTS 4,004,476 A * 1/1977 DeVrou ..... B25B 23/0021 16/431
4,748,872 A * 6/1988 Brown ..... B25B 21/001 81/57.26
4,947,713 A 8/1990 Arnold
6,123,157 A * 9/2000 Barnes ..... B25B 21/00 173/211
6,339,980 B1 1/2002 Woolf
6,397,706 B1 * 6/2002 Maznicki ..... B25B 13/06 81/121.1
6,813,975 B2 * 11/2004 Kozak ..... B25B 23/0021 81/177.6
7,082,864 B1 * 8/2006 Weber ..... B25B 13/06 81/180.1
7,997,169 B1 * 8/2011 Hack ..... B25B 13/06 81/177.2
8,746,114 B2 * 6/2014 Wu ..... B25B 13/461 81/180.1
9,021,922 B2 * 5/2015 Lai ..... B25B 13/46 81/60

(Continued)

*Primary Examiner* — David B Thomas

(74) *Attorney, Agent, or Firm* — Global Intellectual Property Agency, LLC; Jordan Sworen

(57) ABSTRACT

A tool head cover is provided for a rotary tool, which secures over a portion of the tool head and a portion of the rotating member extending therefrom to protect the tool during operation and to protect the user. The device comprises a shank cover member that extends over the rotating member of the tool, whereby the shank cover member has an outer sidewall and a hollow interior portion. The cover may comprise a unitary element that secures to the tool, or alternatively the cover may comprise a multi-component assembly that secures over the tool head using two or more elements. Several embodiments are disclosed. In each embodiment, the cover secures over the junction between the tool head and the tool rotating member, whereby the tool is rotary tool such as a ratchet wrench or powered driver tool.

16 Claims, 4 Drawing Sheets

(56) References Cited

U.S. PATENT DOCUMENTS

| | | | | |
|---|---|---|---|---|
| 9,498,878 | B2 * | 11/2016 | Barker | B25G 1/125 |
| 2003/0121371 | A1 | 7/2003 | Chiu | |
| 2010/0018355 | A1 | 1/2010 | Crawford | |
| 2012/0042754 | A1 * | 2/2012 | Chen | B25B 13/06 81/121.1 |
| 2012/0174716 | A1 * | 7/2012 | Tsai | B25B 13/461 81/60 |
| 2016/0225495 | A1 * | 8/2016 | Kugler | B25F 5/02 |

* cited by examiner

TOOL HEAD COVER

CROSS REFERENCE TO RELATED APPLICATION

This application claims the benefit of U.S. Provisional Application No. 62/085,390 filed on Nov. 28, 2014. The above identified patent application is herein incorporated by reference in its entirety to provide continuity of disclosure.

BACKGROUND OF THE INVENTION

Field of the Invention

The present invention relates to wrench tools with a tool head and a rotating shank member. More particularly, the present invention relates to a protective cover for ratchet tools, rotary wrenches, and powered tools with a rotating tool member or rotating tool shank.

Rotary tools are common devices for assembling or disassembling work pieces. Common rotary tools are used for driving hardware, or for torqueing hardware to a given specification. Rotary tools, as used herein, encompass a large domain of tools, including everyday ratchet wrench tools to industrial-grade driver tools that are powered and employ precise torque settings for a given application. The present invention contemplates a cover device for rotatory tools that has applications across this domain, whereby the cover provides a protective shroud over any rotary tool with a tool head and a rotating shank member extending therefrom (i.e. a rotating shaft, a socket, an extension, etc.). The purpose of the present invention is to provide protection for the tool, and for protecting the user while the rotary tool is in use.

An uncovered rotary tool, and particularly a powered rotary tool, has the capability to inflict serious injury on a user if not handled correctly. Most rotary tools have a stationary handle and tool head, which are gripped by the user. Extending from the tool head is a rotating shank portion used to engage a work piece. The junction between the rotating portion of the tool and the stationary head portion is prone to collect environmental debris, or be susceptible to interference. Contaminants or personal items in contact with the tool between the tool head and the rotating portions can cause damage to the tool, or worse, cause damage to the user or the user's garment when entangled therewith. In the latter case, tools have been known to inflict significant injure to workers and individuals using these tools without sufficient precaution. Clothes, hair, and even digits can become ensnared by the tool. Simultaneously, the tool is susceptible to damage from the environment, as it can draw debris therein, damaging or reducing the performance of the tool. Therefore, a need exist for an efficient and functional cover device for rotary tools.

The present invention provides a tool head cover for a rotary tool that cures these and other known issues. In no particular order, the present invention advances the art by removing in-system damage (ISD) on assembly lines, ensures proper operation of a tool and longevity thereof, prevents interferences with the tool and the environment, and finally, provides a means to protect the tool from damage when dropped or otherwise impacted. While this list is not exhaustive, it is illustrative of the benefits of the cover of the present invention.

In particular, the present invention provides tool head cover that shrouds a portion of the head of a rotary tool, while also shrouding a portion of the tool rotating shank member extending therefrom. The cover comprises a unitary element or multiple-piece assembly that can be designed for a specific rotary tool. In any embodiment, the cover secures over the junction between tool head and the rotating element, thereby protecting the tool from the environment and protecting the user from the tool. Other embodiments are disclosed that include extended portions that operably cover a greater extent of the tool head and/or the tool rotating member. These embodiments are discussed in detail below.

SUMMARY OF THE INVENTION

The following summary is intended solely for the benefit of the reader and is not intended to be limiting in any way. The present invention provides a new tool cover device that can be utilized for providing convenience for the user when securing over a rotary tool head and over the rotating member thereof to protect the tool and the protect the user from the rotating elements of the tool.

It is therefore an object of the present invention to provide a new and improved tool cover device that has all of the advantages of the prior art and none of the disadvantages.

It is another object of the present invention to provide a tool cover device that secures over the head and the rotating member of a rotary tool, thereby protecting the tool from the environment, and protecting the user while handling the tool.

Another object of the present invention is to provide a tool cover device that covers the junction between the tool head and the rotating tool shank using a shank cover member having an outer sidewall forming a hollow interior portion. The shank cover member includes a proximal end and a distal end, whereby the proximal end comprising an opening that is sized to receive a tool head therethrough, and a distal end that is sized to receive the tool shank therethrough. The distal end of the tool comprises an opening to allow the rotating shank of the tool extend therethrough.

Another object of the present invention is to provide a tool cover device that comprises a outer sidewall extending along a portion of the outer surface of the tool head, whereby the tool cover device may comprises a unitary element or an assembly that secures together over the tool head.

Another object of the present invention is to provide a tool cover device, whereby the hollow interior portion of the shank cover member sized to receive a specific tool shank therethrough and allow the tool shank to rotate while in use, while also supporting the tool shank to prevent wobble.

Another object of the present invention is to provide an embodiment of the tool cover device, whereby the proximal end of the shank cover member terminates along the outer surface of the tool head and the outer sidewall of the shank cover member extends along the tool shank length. In this and other embodiments, the shank cover member shrouds the connection between the tool head and the tool shank.

Another object of the present invention is to provide an embodiment of the tool cover device, whereby the outer sidewall of the shank cover member further comprises a tool head sidewall, an adjoining sidewall, and a tool shank sidewall. In this embodiment, the tool head sidewall extends along outer surface of the tool head, the tool shank sidewall extends along extends along a portion of the tool shank, and the adjoining sidewall extends between the tool head sidewall and the tool shank sidewall. The tool head sidewall and the tool shank sidewall are tubular with an axial direction that is substantially aligned.

Another object of the present invention is to provide an embodiment of the tool cover device, whereby the outer sidewall of the shank cover member further comprises a tool head sidewall, an adjoining sidewall, and a tool shank sidewall. In this embodiment, the tool head sidewall has a first diameter and the tool shank sidewall has a second diameter, whereby the first diameter is greater than the second diameter.

Another object of the present invention is to provide an embodiment of the tool cover device, whereby the cover device further comprises a cap portion that removably secures to the proximal end of the shank cover member and over the outer surface of the tool head. In this embodiment, the tool cover comprises separable elements to form a cover assembly.

Another object of the present invention is to provide an embodiment of the tool cover device, whereby the removable cap portion secures to the shank cover member using one or more locking ribs that engage a depression within the outer sidewall of the shank cover member.

Another object of the present invention is to provide an embodiment of the tool cover device, whereby the cap portion extends over the proximal end of the shank cover member and secures using the locking ribs.

Another object of the present invention is to provide an embodiment of the tool cover device, whereby the proximal end of the shank cover member extends over the cap portion and secures using the locking ribs.

Another object of the present invention is to provide an embodiment of the tool cover device, whereby the cap portion having an open lower surface adapted to receive a handle attached to the tool head therethrough.

Another object of the present invention is to provide an embodiment of the tool cover device, whereby the cover is designed to secure to the tool head of a ratchet wrench.

Another object of the present invention is to provide an embodiment of the tool cover device, whereby the cover is designed to secure to the tool head of an impact driver tool.

Another object of the present invention is to provide an embodiment of the tool cover device, whereby the cover is designed to secure over a tool shank that further comprises a socket.

Another object of the present invention is to provide an embodiment of the tool cover device, whereby the cover is designed to secure over a tool shank that further comprises a socket extension.

Another object of the present invention is to provide an embodiment of the tool cover device, whereby the cover is designed to secure over a sock extension and a portion of a socket attached to the socket extension.

Another object of the present invention is to provide an embodiment of the tool cover device, whereby the cover may comprises plastic material, such as Delrin, and may further comprise material that is suitable to be three-dimensionally printed (3-D printing).

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
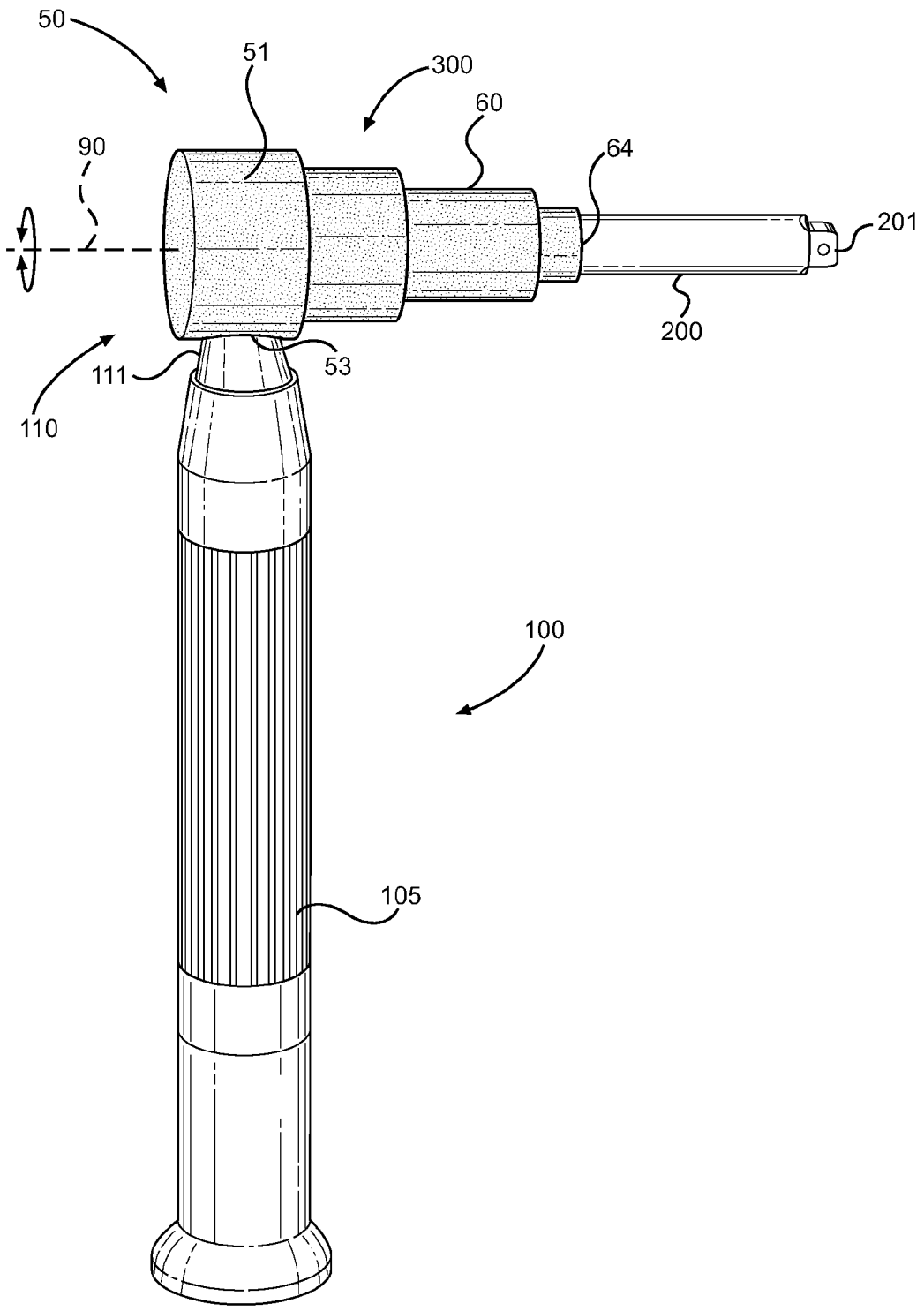
FIG. 1 shows a view of an embodiment of the tool head cover of the present invention in a working state, securing over the tool head and a rotating shank member thereof.

Reference is made herein to the attached drawings. Like reference numerals are used throughout the drawings to depict like or similar elements of the tool cover device of the present invention. For the purposes of presenting a brief and clear description of the present invention, the preferred embodiment will be discussed as used for securing over the junction between the tool head and the rotating shank member thereof to protect the tool and to protect users. The figures are intended for representative purposes only and should not be considered to be limiting in any respect.

Figure 2:
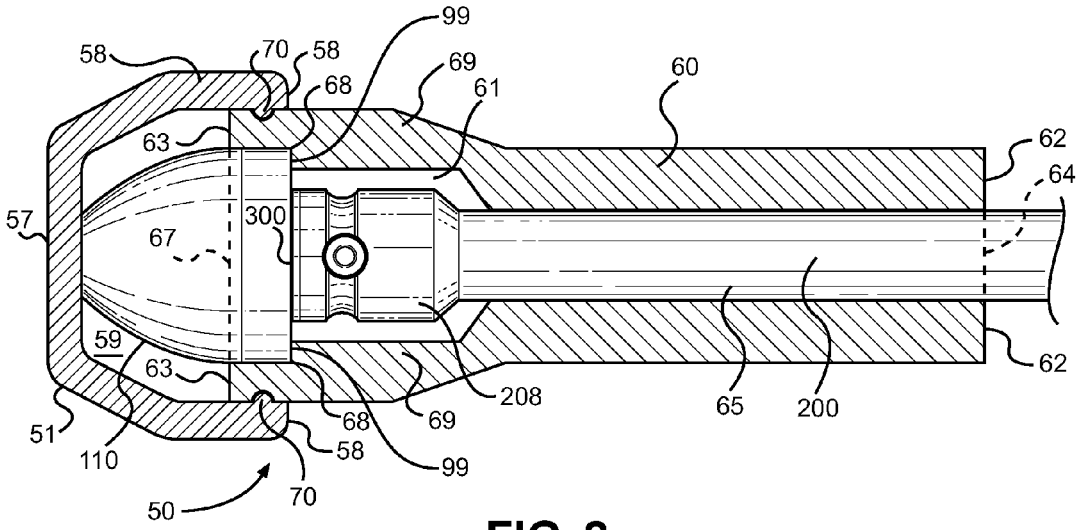
FIG. 2 shows a cross section view of an embodiment of the tool head cover, whereby the cover comprises a two-part assembly.

Referring now to FIG. 1, there is shown a view of an embodiment of the tool cover device 50 of the present invention in a working state. The tool cover device 50 is one that secures against the tool head 110 and the rotating tool shank 200 of a rotary tool 100, and shrouds at least a portion of each. The cover 50 is designed to secure over the junction 300 between the shank 200 and the tool head 110, thereby preventing interferences created by environmental debris or interferences with the user. Several embodiments are provided in the drawing views. The tool cover device 50 includes one of a unitary construction (as shown in FIG. 3), or multi-piece construction (as shown in FIGS. 2 and 4), whereby a portion of the tool head 110 and the tool shank 200 are both covered when the cover 50 is installed on the tool.

The tool cover 50 comprises a shank cover member 60 having an outer sidewall forming a hollow interior portion. The shank cover member 60 has a proximal end and a distal end 64, whereby the proximal end forms an opening that is sized to receive a tool head 110 therethrough and the distal end 64 forms an opening 65 that is sized to receive the tool shank 200 therethrough. The shank cover member 60 secures over the shank 200 of the tool and over the connection 300 between the tool head 110 and the tool shank 200. The shank cover member 60 also extends over a portion of the tool head 110 and may terminate therealong, or optionally secure to a cap portion 51 that is affixed around the head 110 of the tool. Similarly, the cap portion 51 may secure over only a portion of the tool head 110, and further may provide a lower opening 53 to accommodate the upper end 111 of the tool handle 105.

Together, the cap portion 51 and the shank cover member 60 secure over the junction 300 between the tool head 110 and the tool shank portion 200, whereby the shank portion 200 is free to rotate about its axis of rotation 90. The shank cover member 60 prevents interferences with the junction 300, and furthermore may be used to prevent wobble of the tool shank 200 during operation. The shank cover member 60 comprises a hollow interior portion that is sized to receive the tool shank 200 therethrough, as well as the connection fitting of the tool that may secure the shank 200 to the tool head 110. The shank cover member 60 extends along a portion of the tool shank portion 200 length, and may terminate before or over the distal end 201 thereof. In some embodiments, the shank cover member 60 may extend over sockets or other attachments to the end of the tool shank portion 200 (see FIG. 5).

Figure 3:
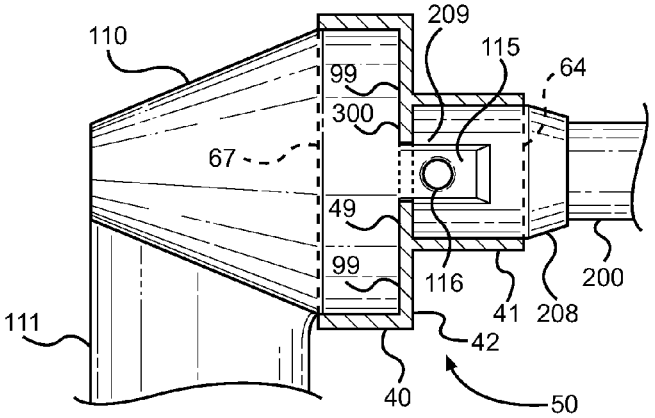
FIG. 3 shows a cross section view of an embodiment of the tool head cover, whereby the cover comprises a unitary assembly.
Figure 4:
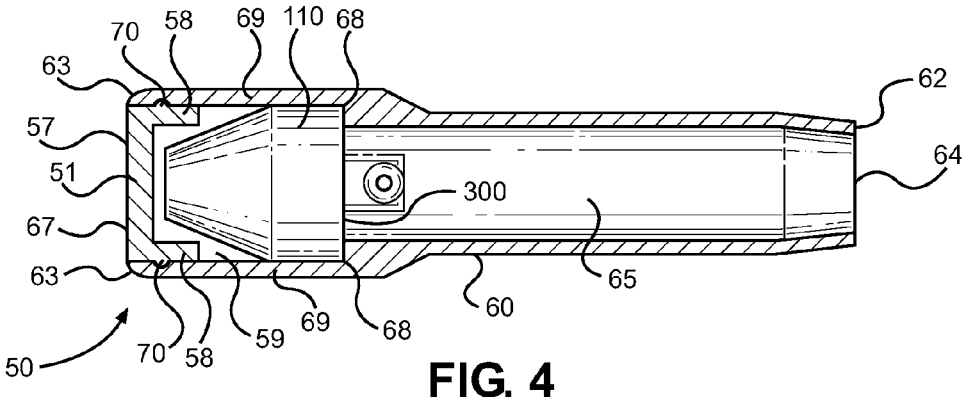
FIG. 4 shows a cross section view of another embodiment of the tool head cover.

Referring now to FIG. 3, there is shown a cross section view of the unitary embodiment of the tool cover 50 installed on the head 110 of a rotary tool. In this embodiment, the shank cover member comprises a unitary element that is positioned over the junction 300 between the tool head 110 and the tool shank 200. The outer sidewall of the cover 50 extends along an outer surface of the tool head and along a portion of the tool shank 200. The outer sidewall further comprises a tool head sidewall 40, an adjoining sidewall 42, and a tool shank sidewall 41. The tool head sidewall 40 extends along outer surface of the tool head 110 and terminates therealong. The tool shank sidewall 41 extends along extend along a portion of the tool shank 200. In between, the adjoining sidewall 42 extends between the tool head sidewall 40 and the tool shank sidewall 42, whereby the tool head sidewall 42 and the tool shank sidewall 41 are tubular and may have different interior diameters. The adjoining sidewall 42 forms a tool head mating surface 99 along the interior of the cover, which is adapted to bear against and mate against the outer surface of the tool head 110.

In use, the tool head sidewall 40 is positioned over the face of a tool head 110 and the tool shank sidewall 42 secures over the shank 200 of the tool (i.e. a ratchet socket, extension, or similar rotary member extending from the tool head). The proximal end 67 of the cover 50 is sized to receive the tool head 110 therein, while the distal end 64 is sized to allow the tool shank 200 therethrough. When installing the unitary embodiment, the cover 50 can be placed against the tool head 110 while the shank 200 is installed or uninstalled. The shank 200, in some embodiments, secures to the tool head 110 using a socket connection fitting 115, which engages the socket interior 209 and is secured in place with a biased ball joint 116. The cover 50 can be installed against the tool head before or after the socket is secured thereto. The cover 50 may extend along the tool head 110 and terminate therealong, or the cover 50 may secure to a removable cap to completely shroud the tool head 110. In still further embodiments, the upper end 111 of the tool may be accommodated by an opening, or by the geometry of the cover 50, to prevent interferences therewith.

In some embodiments, the adjoining sidewall 42 extends between the socket interior 209 and the face of the tool head. An inwardly directed, interior sidewall 49 extends between the socket and the too head and at the junction 300 therebetween. This prevents the tool cover 50 from moving while installed, and furthermore reduces any clearance between the tool head and the tool socket. This prevents any chatter or movement of the tool shank 200 while the shank 200 is being rotated. The inwardly directed sidewall 49 extends within the hollow interior portion a shank cover member 50, and comprises an annular surface with an interior aperture sized to receive the socket connection fitting 115 of the tool. The inwardly directed sidewall 42 is preferably parallel to the opening 64 at the distal end of the shank cover member 50, whereby the inwardly directed sidewall 49 can be positioned between the outer surface of the tool head and the proximal end of the tool shank.

Referring now to FIGS. 2 and 4, there are shown embodiments of the tool cover 50 in which the tool shank 200 and the head 110 are covered using a multi-piece cover assembly. In this embodiment, the outer sidewall 69 of the shank cover member 60 extends along an outer surface of the tool head 110 and secures to a cap portion 51. The cap portion 51 removably secures to the proximal end 63 of the shank cover member 60 and over the outer surface of the tool head 110. The cap portion 51 and the shank cover member 60 removably affix to one another to form a continuous cover over the tool head 110 and the tool shank 200.

In this embodiment, the shank cover member 60 comprises a proximal end 63, a distal end 64, and a rounded sidewall 69 with an open interior 61. The shank cover member 60 is tubular, whereby the proximal end 63 comprises an opening 67 sized to receive the tool head 110 or tool shank 200 therein. The distal end 62 further comprises an opening 64, 65 sized to receive the tool shank 200 therethrough. The opening 61 of the shank cover member 60 may have a uniform diameter therealong, or may alternatively comprise a stepped diameter to accommodate the shank 200 and a connecting member 208 (e.g. the widened base of a socket extension). Together, the cap portion 51 and the shank cover member 60 secure over the junction 300 between the tool head 110 and the tool shank 200.

The cap portion 51 comprises a pair of arms 58, an open interior 58, and a rear surface 57 that surround the tool head 110. The cap portion 51 secures to the proximal end 63 of the shank cover member 200 to removably secure the two together while the tool is in operation. In one embodiment, the cap portion 51 secures to the shank cover member 200 using one or more locking ribs 70 that engage a depression within the outer sidewall 69 of the shank cover member 60. In another embodiment, the locking ribs 70 extend outward from the shank cover member 60 and engage depressions in the cap portion 51. Further still, the cap portion 51 may extend over the proximal end 63 of the shank cover member 60 (FIG. 2), or the shank cover member 60 may extend over the end 58 of the cap portion 51 (FIG. 4).

In still yet other embodiments, the shank cover member 60 may comprises a notch 68 along the proximal end 67 thereof to form a mating surface 99. The mating surface 99 is adapted to engage the forward face of the tool head 110 and allow the shank cover member 60 to bear thereagainst. The notch is formed by a series of internal shank cover surfaces, comprising the tool head sidewall surface, the adjoining sidewall surface, and the tool shank sidewall surface. These surfaces form the internal notch 68 and mating surface 99, against which the shank cover member can be pressed against the face of the tool head 110. The cap portion 51 can then be secured to the proximal end 63 of the shank cover member 60, whereby the cap portion 51 is form-fitted around the tool head 100, or provides internal clearance within its interior volume 59.

Figure 5:
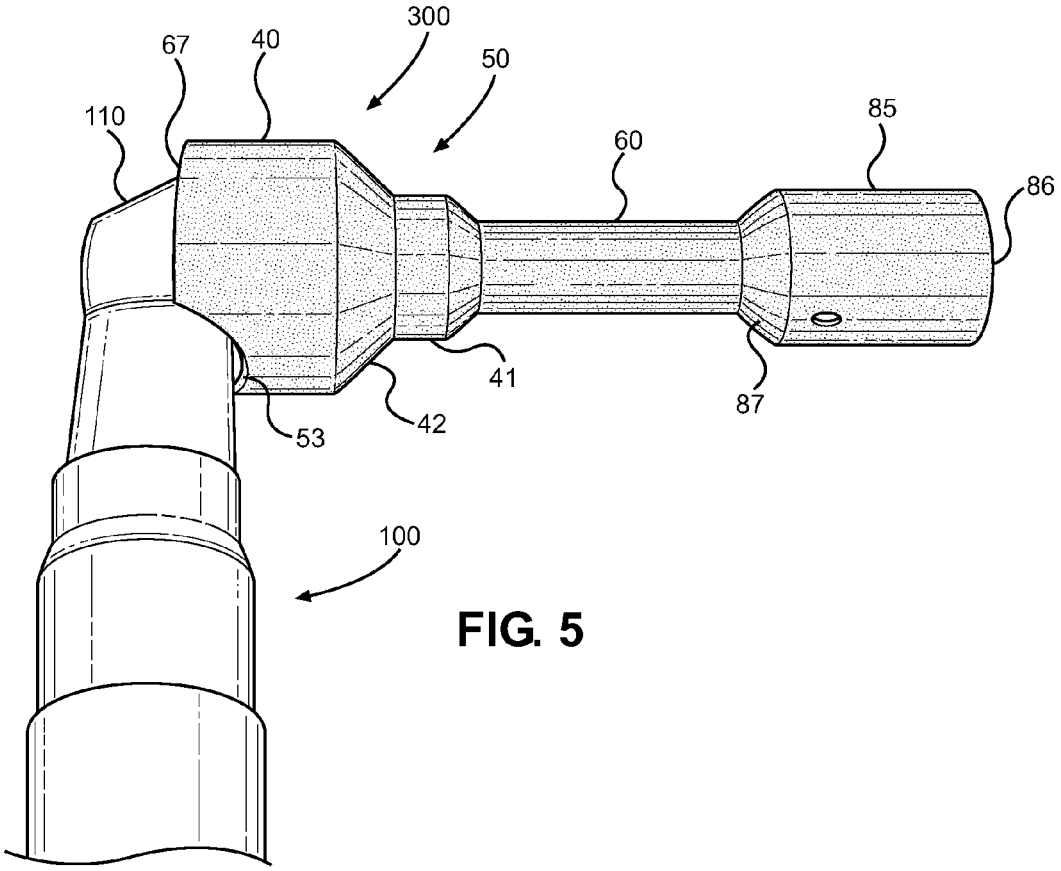
FIG. 5 shows a view of yet another embodiment of the tool head cover.

In yet another embodiment, the cover 50 of the present invention provides a shank cover member 60 that extends along the tool shank extends over a socket member affixed to the distal end thereof. In this embodiment, and as shown in FIG. 5, the cover 50 comprises a proximal end 67 that terminates along the outer surface of the tool head 110. The cover secures over the junction 300 of the tool head 110 and the tool shank, and extends along the tool shank to its distal end. The tool shank is first affixed to the tool head 110, whereafter the shank cover member 60 is placed thereover. The distal end of the shank cover member 60 comprises a socket portion 85, whereby a socket can be secured therein and affixed to the distal end of the tool shank. The socket portion 85 may comprise a wider diameter than the shank cover member 60, whereby a socket can be inserted through the distal end 86 thereof and the shank cover member 60 has a transition 87 along its length between the different diameters. Furthermore, the proximal end of the shank cover member 60 may comprise a tool head sidewall 40, an adjoining sidewall 42, and a tool shank sidewall 41, whereby the tool head sidewall 40 is a greater diameter than the shank cover member 60. This embodiment, as shown in FIG. 5, may further comprise a unitary or multi-piece construction. Furthermore, the lower end of the tool head sidewall 40 may comprise a cut-out 53 to accommodate the handle of the tool 100.

Figure 6:
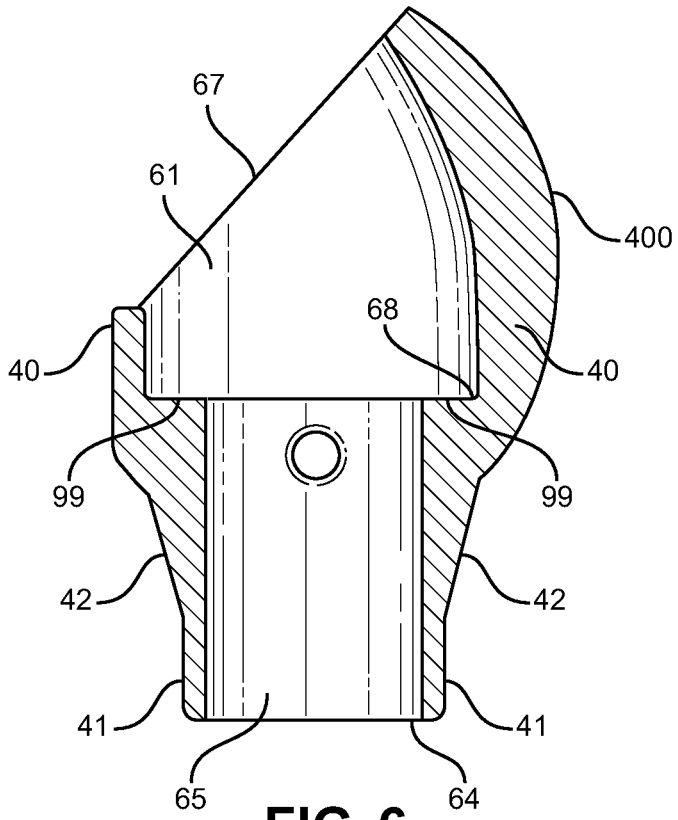
FIG. 6 shows a cross section view of another embodiment of the tool head cover.
Figure 7:
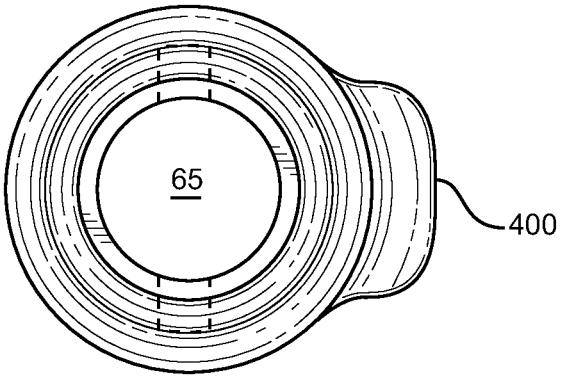
FIG. 7 shows an end view of the embodiment shown in FIG. 6.

Referring to FIGS. 6 and 7, there is shown another embodiment of the cover 50 of the present invention. Similar to FIG. 3, this embodiment comprises a tool head sidewall 40, an adjoining sidewall 42, and a tool shank sidewall 41. The tool head sidewall 40 extends along outer surface of the tool head and terminates therealong, while the tool shank sidewall 41 extends along the shank of the tool. In this embodiment, the cover comprises an enlarged thickness to protect the tool, and may comprise a material of a durometer that is comfortable to handle and protective of the tool. Specifically, the material may comprises a soft rubber or the like that compresses when grasped or dropped. Along the upper portion of the tool head and along the tool head sidewall 40 is a raised portion 400. The raised portion 400 comprises a region of increased thickness that is adapted to compress if the tool is dropped or grasped, thus protecting the tool head from damage and providing a comfortable grip of the user. The interior of the tool head cover includes a notch 68 forming a tool mating surface 99, a tool shank interior 65 sized to receive the shank of a tool therein, a distal end opening 64, and a proximal end opening 67. The proximal end opening 67 receives the tool head into the interior 61 of the cover, while the raised portion 400 extends over the head of the tool.

In particular, the embodiment of FIGS. 6 and 7 comprises an upper surface and a lower surface. The upper surface is adapted to be positioned over an upper surface of the tool head, while the lower surface is adapted to be positioned opposite of the upper surface. The upper surface of the cover further comprises a greater thickness than the lower surface of the tool head surface to form a raised portion therealong. The raised portion protects the tool head and is compressible. In this embodiment, the cover may comprise a molded part from an elastomeric, compressible material.

Overall, the tool cover of the present invention provides a shroud over a rotary tool, whereby the junction between the tool head and the rotary portion thereof is covered. This prevents interferences, injury, and damage to the tool. The cover is one that can be manufactured of various materials, whereby the cover provides a shroud over the tool, as well as a measure of impact resistance when the tool is dropped. Contemplated materials include various plastics, such as Delrin, as well as rubber and other suitable materials. The cover may comprise a rigid material, or one that exhibiting sufficient flexibility to be placed over the tool to conform thereto. It is not desired to limit the material of the cover, but rather to disclose the structural elements used to secure over the head and the rotating element of a rotary tool. In some embodiments, the material may be three-dimensionally printed for a specific tool.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool head cover for a tool with a rotating tool shank, comprising:

a shank cover member having an outer sidewall forming a hollow interior portion;

the shank cover member having a proximal end and a distal end;

the proximal end comprising an opening that is sized to receive a tool head therethrough;

the outer sidewall extending along an outer surface of the tool head;

the hollow interior portion of the shank cover member sized to receive a tool shank therethrough;

the distal end of the shank cover member comprising an opening that is sized to receive the tool shank therethrough;

whereby the proximal end of the shank cover member terminates along the outer surface of the tool head and the outer sidewall of the shank cover member extends along a portion the tool shank;

whereby the shank cover member shrouds a connection between the tool head and the tool shank.

2. The tool head cover of claim 1, wherein:

the outer sidewall of the shank cover member further comprises a tool head sidewall, an adjoining sidewall, and a tool shank sidewall;

whereby the tool head sidewall extends along outer surface of the tool head;

whereby the tool shank sidewall extends along extend along a portion of the tool shank;

whereby the tool head sidewall and the tool shank sidewall are tubular with an axial direction that is substantially aligned; and whereby the adjoining sidewall extends between the tool head sidewall and the tool shank sidewall.

3. The tool head cover of claim 2, wherein:

the tool head sidewall has a first diameter and the tool shank sidewall has a second diameter;

whereby the first diameter is greater than the second diameter.

4. The tool head cover of claim 2, wherein the tool head sidewall further comprises:

an upper surface and a lower surface;

whereby the upper surface is adapted to be positioned over an upper surface of the tool head; and whereby the upper surface of the tool head sidewall further comprises a greater thickness than the lower surface of the tool head surface to form a raised portion therealong.

5. The tool head cover of claim 1, further comprising:

a cap portion that removably secures to the proximal end of the shank cover member and over the outer surface of the tool head.

6. The tool head cover of claim 1, further comprising:

a cap portion that removably secures to the proximal end of the shank cover member and over the outer surface of the tool head;

whereby the cap portion secures to the shank cover member using one or more locking ribs that engage a depression within the outer sidewall of the shank cover member.

7. The tool head cover of claim 1, further comprising:

a cap portion that removably secures to the proximal end of the shank cover member and over the outer surface of the tool head;

whereby the cap portion secures to the shank cover member using one or more locking ribs that engage a depression within the outer sidewall of the shank cover member;

whereby the cap portion extends over the proximal end of the shank cover member.

8. The tool head cover of claim 1, further comprising:

a cap portion that removably secures to the proximal end of the shank cover member and over the outer surface of the tool head;

whereby the cap portion secures to the shank cover member using one or more locking ribs that engage a depression within the outer sidewall of the shank cover member;

whereby the proximal end of the shank cover member extends over the cap portion.

9. The tool head cover of claim 1, further comprising:

a cap portion that removably secures to the proximal end of the shank cover member and over the outer surface of the tool head;

the cap portion having an open lower surface adapted to receive a handle attached to the tool head therethrough.

10. The tool head cover of claim 1, whereby the tool head further comprises a ratchet wrench tool head.

11. The tool head cover of claim 1, whereby the tool head further comprises an impact driver tool.

12. The tool head cover of claim 1, whereby the tool shank further comprises a socket.

13. The tool head cover of claim 1, whereby the tool shank further comprises a socket extension.

14. The tool head cover of claim 1, whereby the tool shank further comprises a sock extension and a socket attached thereto.

15. The tool head cover of claim 1, further comprising:

an inwardly directed sidewall extending within the hollow interior portion a shank cover member;

the inwardly directed sidewall comprising an annular surface with an interior aperture;

the inwardly directed sidewall adapted to be positioned between the outer surface of the tool head and a portion the tool shank.

16. The tool head cover of claim 1, further comprising:

an inwardly directed sidewall extending within the hollow interior portion a shank cover member;

the inwardly directed sidewall comprising an annular surface with an interior aperture;

the inwardly directed sidewall being substantially parallel to the opening at the distal end of the shank cover member;

the inwardly directed sidewall adapted to be positioned between the outer surface of the tool head and a portion the tool shank.

* * * * *